US007367751B2

(12) United States Patent
Vosbikian

(10) Patent No.: US 7,367,751 B2
(45) Date of Patent: May 6, 2008

(54) FRICTION ROCK STABILIZER WITH POINT ANCHOR

(75) Inventor: Thomas J. Vosbikian, Marlton, NJ (US)

(73) Assignee: International Rollforms Inc., Deptford, NJ (US)

( * ) Notice: Subject to any disclaimer, the term of this patent is extended or adjusted under 35 U.S.C. 154(b) by 0 days.

(21) Appl. No.: 11/526,450

(22) Filed: Sep. 25, 2006

(65) Prior Publication Data

US 2008/0075539 A1 Mar. 27, 2008

(51) Int. Cl.
*E21D 21/00* (2006.01)

(52) U.S. Cl. ..... 405/259.3

(58) Field of Classification Search ..... 411/54.1, 411/61; 405/259.3, 259.4
See application file for complete search history.

(56) References Cited

U.S. PATENT DOCUMENTS 4,098,087 A 7/1978 Swain
4,312,604 A 1/1982 Fu et al.
4,382,719 A * 5/1983 Scott ..... 405/259.3
4,445,808 A 5/1984 Arya
4,652,178 A 3/1987 Kates et al.
5,033,909 A * 7/1991 McCartney ..... 405/259.3
5,295,768 A 3/1994 Buchhorn et al.
6,935,811 B2 * 8/2005 Simmons et al. ..... 405/259.3

* cited by examiner

*Primary Examiner*—John Kreck
(74) *Attorney, Agent, or Firm*—Norman E. Lehrer

(57) ABSTRACT

A friction rock stabilizer includes an elongated metal tube having and interior and an exterior surface with a distal end and a proximal end. The distal end is tapered and a flange is positioned adjacent the proximal end. The tube further includes a slit that runs substantially the entire length thereof. The tube is constructed so as to be capable of being positioned within a bore formed in the wall of a mine. An internal sleeve is located adjacent the distal end of the tube. A tapered expander is also located within the interior of the tube adjacent the distal end and is actuatable from the proximal end of the tube after the point anchor is installed in a bore. The tapered expander expands the distal end of the tube to firmly anchor the stabilizer in the bore.

3 Claims, 2 Drawing Sheets

FRICTION ROCK STABILIZER WITH POINT ANCHOR

BACKGROUND OF THE INVENTION

The present invention is directed toward a friction rock stabilizer and, more particularly, toward a friction rock stabilizer that includes an improved point anchor for increased holding strength and life expectancy.

Ground support, especially in the mining industry, is an important safety factor that must be taken into consideration during any type of excavating activity. Rock stabilizers, or rock bolts, have been used for many years to support exposed rock during mining operations. A number of types of rock bolts are used depending on the situation, such as ground conditions, costs, personal preferences, etc. There are three primary types of rock bolts. The first is an expansion shell type bolt where a screw threaded steel bar is inserted into a drilled hole in the rock. The bolt has a "shell" at its tip. Once the bolt is inserted into the drilled hole and is turned, the shell expands to the sides of the hole and grips the rock so that the steel bar can then be tensioned. This results in bolting the rock strata layers together.

Grouted bar type stabilizers are also known. These include a ribbed bar which is inserted into a drilled hole and which hole is then further filled with a specialized cement or resin-based grout. This type of support depends directly on the bond between the rock and the grout and the grout and the steel bar and acts like a reinforcing bar.

Another effective anchoring system that is currently used is commonly referred to as a Split Set available from International Rollforms of Deptford, N.J. A Split Set is a brand of a friction rock stabilizer that includes an elongated tube and a bearing plate. The tube is typically made from resilient steel and has a slit along its length so that the tube will be compressible for insertion into a pre-drilled bore in a mine roof or wall. One end of the tube is tapered and the other end has a ring flange. In order to install the split set, the bearing plate is placed against a surface to be supported, such as a wall or roof of a mine. The tapered end of the tube is then driven through the aperture and as the tube slides into place, the slot narrows. The tube exerts radial pressure against the surface over its full contact length and provides plate load support. The result is a tight grip brought about by the friction generated between the outer steel wall of the tube or cylinder and the inner side wall of the bore in the wall. Such systems are described, for example, in U.S. Pat. No. 5,295,768 to Buchhorn et al., U.S. Pat. No. 4,652,178 to Kates et al., U.S. Pat. No. 4,445,808 to Arya, and U.S. Pat. No. 4,382,719 to Scott.

The interior of these rock stabilizers can frequently corrode due to the steel being exposed to the atmosphere within the mine. Over time, this can limit the useful life of the stabilizer. It has been known, therefore, to fill the interior of the cylindrical rock stabilizer after it has been inserted into the bore with a grouting material. This helps not only to improve the useful life of the stabilizer but also to increase its holding strength.

Even further, and as described more fully in published PCT Application No. WO 99/05031 to Smith, it is also known to crimp the tube or form indentations or undulations at various places along the length of the stabilizer and which communicate with the open slit. These indentations allow the grout or other resinous material to extrude out of the interior of the stabilizer, through the slit and into the recessed area or undulation formed in the outer wall of the stabilizer. This allows more of the grout to come in contact with the bore hole and to increase the frictional holding of the stabilizer. The grout also helps to insulate the outer wall of the stabilizer from moisture to thereby increase the longevity thereof.

It is also known to utilize wedges within the rock stabilizer to increase the frictional holding thereof. This is accomplished by forcing a wedge-shaped member into the interior of the stabilizer after the stabilizer has been driven into place so that it can engage a portion of the interior wall of the stabilizer or another wedge-shaped member therein to expand a portion of the stabilizer wall to force it into contact with the interior wall of the bore. Examples of such devices are described in U.S. Pat. No. 4,312,605 to Fu et al., U.S. Pat. No. 4,098,087 to Swain, and published PCT Application No. WO 88/02437 to Hilton.

While the above-described systems are individually well known and the wedge expanders of the prior art may be of some use, the wedge expanders are somewhat complex and difficult to employ in the field.

SUMMARY OF THE INVENTION

The present invention is designed to overcome the deficiencies of the prior art discussed above. It is an object of this invention to provide a friction rock stabilizer that includes an improved point anchor that has all of the advantages of the wedge expander systems of the prior art.

It is a further object of the present invention to provide a friction rock stabilizer that is relatively simple to install.

It is a still further object of the present invention to provide a friction rock stabilizer that includes a novel and more efficient tapered expander member.

In accordance with the illustrative embodiments demonstrating features and advantages of the present invention, there is provided a friction rock stabilizer with a point anchor that includes an elongated metal tube having and interior and an exterior surface with a distal end and a proximal end. The distal end is tapered and a flange is positioned adjacent the proximal end. The tube further includes a slit that runs substantially the entire length thereof. The tube is constructed so as to be capable of being positioned within a bore formed in the wall of a mine. An internal sleeve is positioned within the distal tapered end. A tapered expander is also located within the interior of the tube adjacent the distal end and is actuatable from the proximal end of the tube after the stabilizer is installed in a bore. The tapered expander expands the distal end of the tube to firmly anchor the stabilizer in the bore.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
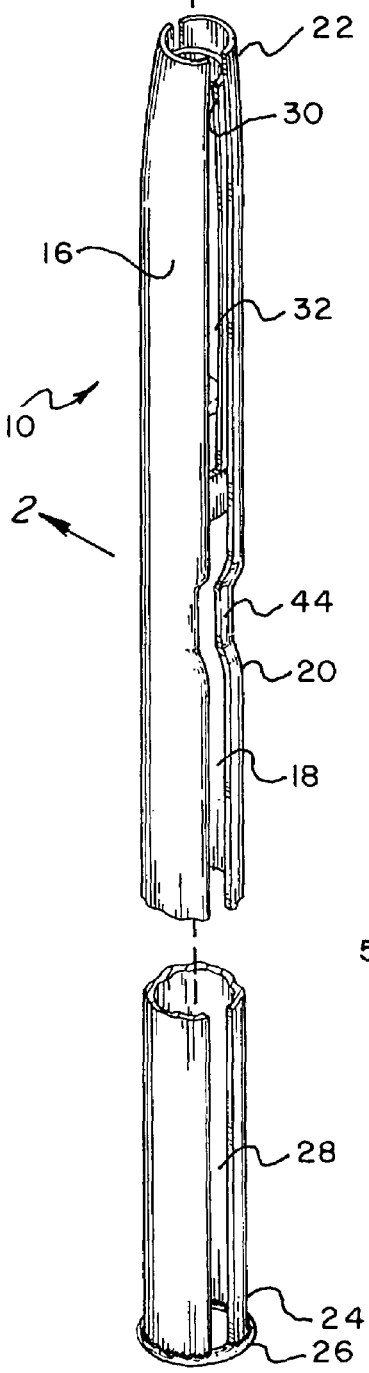
FIG. 1 is a perspective view shown partially broken away of the friction rock stabilizer with a point anchor of the present invention.
Figure 3:
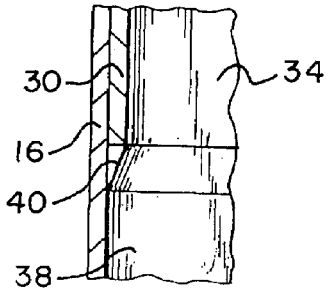
FIG. 3 is a cross-sectional view taken through line 3-3 of FIG. 2.

Referring now to the drawings in detail wherein like reference numerals have been used throughout the various figures to designate like elements, there is shown in FIG. 1 a friction rock stabilizer with a point anchor constructed in accordance with the principles of the present invention and designated generally as 10.

The friction rock stabilizer 10 is comprised essentially of an elongated metal tube 16 having a hollow interior 18 and an exterior substantially cylindrically shaped surface 20. The tube 16 has a distal end 22 which is preferably tapered so as to be slightly smaller in diameter at the end than throughout the remaining parts of the tube and a proximal end 24 including a flange 26. The tube 16 also includes a slit 28 running substantially the entire length thereof.

The stabilizer system 10 described to this point is, per se, known in the art. As is also well known, the diameter of the tube 16 is slightly greater than the diameter of the bore 12 in the mine ceiling 14. As a result, when the tube 16 is driven into the bore, the outer walls compress so as to create a frictional engagement between the friction rock stabilizer 10 and the interior wall of the bore 12.

As should also be readily apparent to those skilled in the art, before the stabilizer 10 is driven into the bore 12, a plate with an opening therein is normally passed around the tube 16 and is held in place by the flange 26. The plate helps to support the rock and also provides a means for hanging a lamp or securing accessories or the like to the mine ceiling. Again, such features are well known in the art.

Located with the tapered distal end 22 of the tube 16 is an internal sleeve 30 having a slit 32 similar to the slit 28 of the tube 16. A can be seen, the internal sleeve 30 has an outer shape and diameter that is essentially the same as the internal diameter of the distal end of the tube 16. Also located within the interior 18 of the tube 16 and partially within the internal sleeve 30 is a tapered expander mechanism 34 of circular cross section. (See FIG. 2.) The tapered expander 34 is preferably stepped in that it has a forward reduced diameter portion 36 and a rear slightly larger diameter portion 38 with a chamfer 40 located between the two. The forward most end of the tapered expander 34 is also preferably chamfered as shown at 42.

Figure 2:
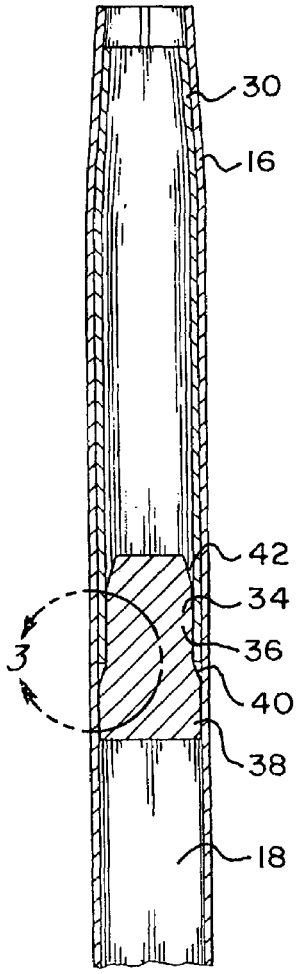
FIG. 2 is a partial cross sectional view of the upper portion of FIG. 1 showing the details of the distal end of the system.
Figure 4:
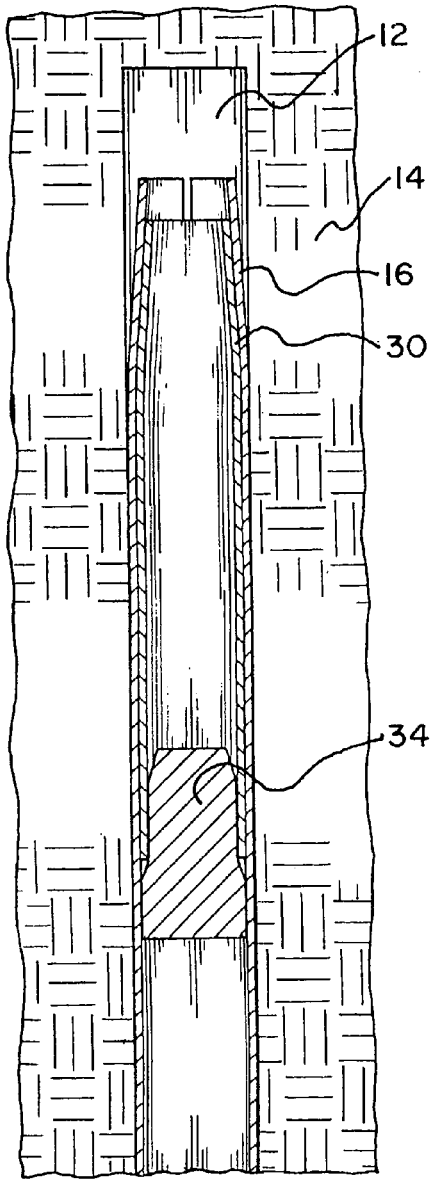
FIG. 4 is a partial cross sectional view of the upper portion of the distal end of the friction rock stabilizer similar to FIG. 2 but showing the stabilizer within a bore formed in the wall of a mine.

The stabilizer 10 of the present invention is used in the following manner. Initially, a bore 12 is drilled into the rock 14. The length of the bore 12 is slightly greater than the length of the tube 16 to ensure that the tube can be fully inserted therein. The stabilizer is preassembled with the internal sleeve 30 and tapered expander 34 in place and arranged as shown in FIGS. 1, 2, and 4. If desired, the tube 16 can be crimped such as shown at 44 in FIG. 1 to maintain the various parts in their proper place. As will be readily apparent, there is no need to weld or otherwise attach the parts together as the device will function properly even if the sleeve 30 and tapered expander 34 become dislodged and move as they will always remain in proper orientation.

Figure 6:
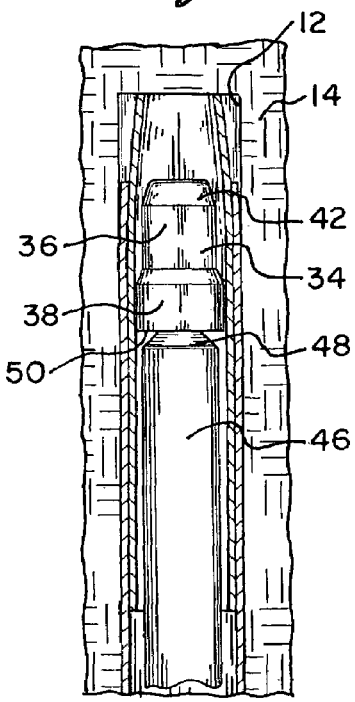
FIG. 6 is a cross sectional view similar to FIG. 5 showing the point anchor in its actuated position.
Figure 5:
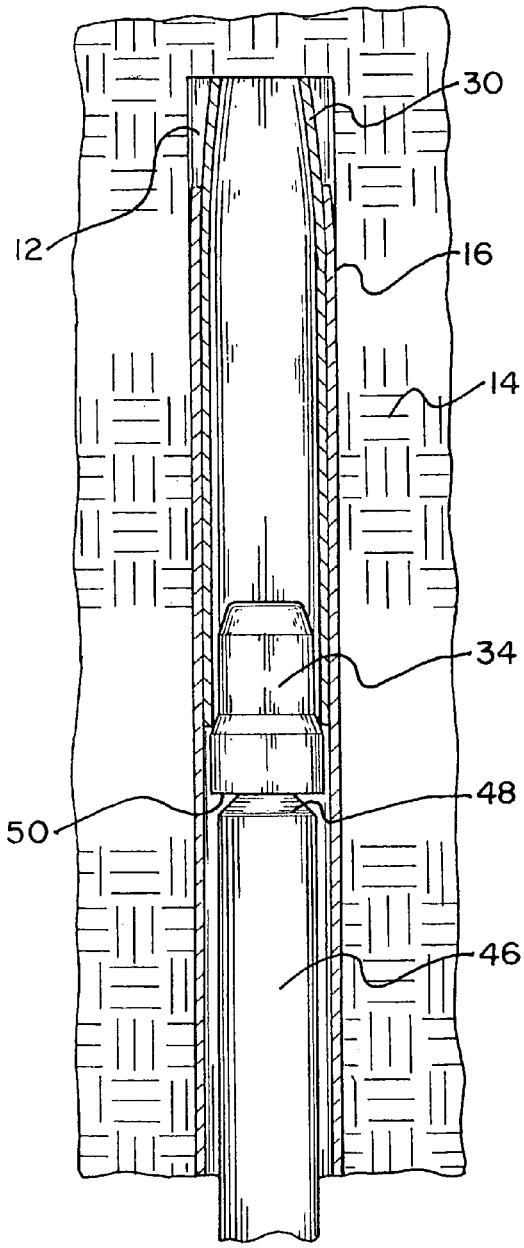
FIG. 5 is a cross-sectional view similar to FIG. 4 but showing the point anchor being actuated.

After the stabilizer 10 is driven into the bore 12 and is properly positioned as shown in FIG. 4, an elongated rod such as shown at 46 in FIG. 5 is then forced into the interior of the tube 16. The upper end 48 of the rod 46 engages the lowermost or rear surface 50 of the tapered expander 34. While the rod 36 is forced inwardly, the tapered expander 38 moves upwardly as well. As the tapered expander 34 continues to move upwardly, the diameter of the sleeve 30 increases. This action causes the wall of the tube 16 at the distal end 22 to expand and thereby anchor the rock stabilizer 10 in place. (See FIG. 6.)

In some cases, the movement of the tapered expander 34 may cause the sleeve 30 to move inwardly or out of the extreme distal end 22 of the tube 16 but the sleeve 30 will stop once it hits the end of the bore 12 as shown in FIG. 5. At that point, the tapered expander 34 will continue to move into the sleeve 30 and will continue to expand the distal end 22 of the tube 16 until it is properly anchored in place. (See FIG. 6.)

The present invention may be embodied in other specific forms without departing from the spirit or essential attributes thereof and accordingly, reference should be made to the appended claims rather than to the foregoing specification as indicating the scope of the invention.

I claim:

1. A friction rock stabilizer comprising:

an elongated metal tube having and interior and an exterior surface and including a distal end and a proximal end, said distal end being tapered, a flange located adjacent said proximal end, said tube further including a slit running substantially the entire length thereof, said tube being capable of being positioned within a bore formed in the wall of a mine;

an internal sleeve located within and adjacent said distal end of said interior of said tube, said sleeve being moveable within said tube, and tapered expander means located within said interior of said tube adjacent said distal end, said tapered expander means being actuatable from said proximal end after said stabilizer is installed in a bore to expand said sleeve and said distal end of said tube so as to firmly anchor said stabilizer in said bore, wherein said tapered expander means is circular in cross section and includes a reduced diameter portion, an increased diameter portion and a chamfered area between said two portions.

2. The friction rock stabilizer of claim 1 wherein said tapered expander means is located within said sleeve.

3. The friction rock stabilizer of claim 1 wherein said sleeve has a slit extending the length thereof.

* * * * *